US006786010B1

(12) United States Patent
Mc Nabb

(10) Patent No.: US 6,786,010 B1
(45) Date of Patent: Sep. 7, 2004

(54) OUTDOOR STORAGE STRUCTURE

(76) Inventor: William R. Mc Nabb, P.O. Box 274, Zebulon, NC (US) 27597

( * ) Notice: Subject to any disclaimer, the term of this patent is extended or adjusted under 35 U.S.C. 154(b) by 0 days.

(21) Appl. No.: 10/259,924

(22) Filed: Sep. 27, 2002

(51) Int. Cl.[7] ..... E04D 1/36; E04D 13/14; E04D 3/38

(52) U.S. Cl. ..... 52/60; 52/DIG. 12; 135/118; 135/137; 135/116; 292/340; 292/281; 16/110.1; 16/436; 312/244

(58) Field of Search ..... 52/66, DIG. 12, 52/DIG. 14, 79.1; 135/118, 137, 116; 411/387; 292/340, 281; 312/244; 16/110.1, 436; 220/76.8

(56) References Cited

U.S. PATENT DOCUMENTS

| | | | | | |
|---|---|---|---|---|---|
| 2,098,469 | A | * | 11/1937 | Smith | 52/66 |
| 2,318,518 | A | * | 5/1943 | Opperer | 4/246.1 |
| 2,712,677 | A | * | 7/1955 | Hyde | 52/66 |
| 3,009,211 | A | * | 11/1961 | Hansen et al. | 52/66 |
| 3,797,178 | A | * | 3/1974 | Mule | 52/66 |
| 3,861,092 | A | | 1/1975 | Dale et al. | |
| 3,915,144 | A | * | 10/1975 | Tomita | 126/9 R |
| 3,945,159 | A | | 3/1976 | Girnus, Sr. | |
| 4,296,575 | A | | 10/1981 | Verable et al. | |
| 4,306,390 | A | | 12/1981 | Brown | |
| 4,322,118 | A | * | 3/1982 | Shugart | 312/111 |
| 5,033,497 | A | * | 7/1991 | Hernandez | 135/95 |
| 5,414,966 | A | | 5/1995 | Montoya | |
| 5,492,442 | A | * | 2/1996 | Lasner | 411/426 |
| 5,533,616 | A | * | 7/1996 | Crowfoot | 206/335 |
| 5,562,115 | A | * | 10/1996 | Sotelo | 135/156 |
| D405,045 | S | | 2/1999 | Sauve et al. | |
| 6,263,601 | B1 | * | 7/2001 | Emert | 292/281 |
| D460,656 | S | * | 7/2002 | Caulder | D7/332 |

* cited by examiner

*Primary Examiner*—Carl D. Friedman
*Assistant Examiner*—Nahid Amiri

(57) ABSTRACT

An outdoor storage structure for storing equipment and lawn accessories in a portable shed. The outdoor storage structure includes a base assembly including a base floor and anchor members being attached to sides of the base floor for anchoring the base floor to a ground; and also includes a cover member being hingedly attached along a back edge of the base floor and including top, side, front, and back walls; and further includes hinge members being attached to the base floor and to the cover member; and also includes handle members being attached to the cover member for the lifting thereof; and further includes a lock assembly for locking the cover member to the base assembly; and also includes a light-emitting member being disposed upon an underside of the cover member; and further includes an alarm member also being disposed upon the underside of the cover member.

6 Claims, 3 Drawing Sheets

OUTDOOR STORAGE STRUCTURE

BACKGROUND OF THE INVENTION

1. Field of the Invention

The present invention relates to storage structures and more particularly pertains to a new outdoor storage structure for storing equipment and lawn accessories in a portable shed.

2. Description of the Prior Art

The use of storage structures is known in the prior art. More specifically, storage structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,414,966; U.S. Pat. No. 4,296,575; U.S. Pat. No. 3,945,159; U.S. Pat. No. 3,861,092; U.S. Pat. No. 4,306,390; and U.S. Pat. No. Des. 405,045.

While these devices fulfill their respective, particular objectives and requirements, the aforementioned patents do not disclose a new outdoor storage structure. The inventive device includes a base assembly including a base floor and anchor members being attached to sides of the base floor for anchoring the base floor to a ground; and also includes a cover member being hingedly attached along a back edge of the base floor and including top, side, front, and back walls; and further includes hinge members being attached to the base floor and to the cover member; and also includes handle members being attached to the cover member for the lifting thereof; and further includes a lock assembly for locking the cover member to the base assembly; and also includes a light-emitting member being disposed upon an underside of the cover member; and further includes an alarm member also being disposed upon the underside of the cover member.

In these respects, the outdoor storage structure according to the present invention substantially departs from the conventional concepts and designs of the prior art, and in so doing provides an apparatus primarily developed for the purpose of storing equipment and lawn accessories in a portable shed.

SUMMARY OF THE INVENTION

In view of the foregoing disadvantages inherent in the known types of storage structures now present in the prior art, the present invention provides a new outdoor storage structure construction wherein the same can be utilized for storing equipment and lawn accessories in a portable shed.

The general purpose of the present invention, which will be described subsequently in greater detail, is to provide a new outdoor storage structure which has many of the advantages of the storage structures mentioned heretofore and many novel features that result in a new outdoor storage structure which is not anticipated, rendered obvious, suggested, or even implied by any of the prior art storage structures, either alone or in any combination thereof.

To attain this, the present invention generally comprises a base assembly including a base floor and anchor members being attached to sides of the base floor for anchoring the base floor to a ground; and also includes a cover member being hingedly attached along a back edge of the base floor and including top, side, front, and back walls; and further includes hinge members being attached to the base floor and to the cover member; and also includes handle members being attached to the cover member for the lifting thereof; and further includes a lock assembly for locking the cover member to the base assembly; and also includes a light-emitting member being disposed upon an underside of the cover member; and further includes an alarm member also being disposed upon the underside of the cover member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new outdoor storage structure which has many of the advantages of the storage structures mentioned heretofore and many novel features that result in a new outdoor storage structure which is not anticipated, rendered obvious, suggested, or even implied by any of the prior art storage structures, either alone or in any combination thereof.

It is another object of the present invention to provide a new outdoor storage structure which may be easily and efficiently manufactured and marketed.

It is a further object of the present invention to provide a new outdoor storage structure which is of a durable and reliable construction.

An even further object of the present invention is to provide a new outdoor storage structure which is susceptible of a low cost of manufacture with regard to both materials and labor, and which accordingly is then susceptible of low prices of sale to the consuming public, thereby making such outdoor storage structure economically available to the buying public.

Still yet another object of the present invention is to provide a new outdoor storage structure which provides in the apparatuses and methods of the prior art some of the advantages thereof, while simultaneously overcoming some of the disadvantages normally associated therewith.

Still another object of the present invention is to provide a new outdoor storage structure for storing equipment and lawn accessories in a portable shed.

Yet another object of the present invention is to provide a new outdoor storage structure which includes a base assembly including a base floor and anchor members being attached to sides of the base floor for anchoring the base floor to a ground; and also includes a cover member being hingedly attached along a back edge of the base floor and including top, side, front, and back walls; and further includes hinge members being attached to the base floor and to the cover member; and also includes handle members being attached to the cover member for the lifting thereof; and further includes a lock assembly for locking the cover member to the base assembly; and also includes a light-emitting member being disposed upon an underside of the cover member; and further includes an alarm member also being disposed upon the underside of the cover member.

Still yet another object of the present invention is to provide a new outdoor storage structure that is easy and convenient to set up and use.

Even still another object of the present invention is to provide a new outdoor storage structure that safely secures equipment and other types of accessories so as to prevent loss through theft of such equipment and accessories.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
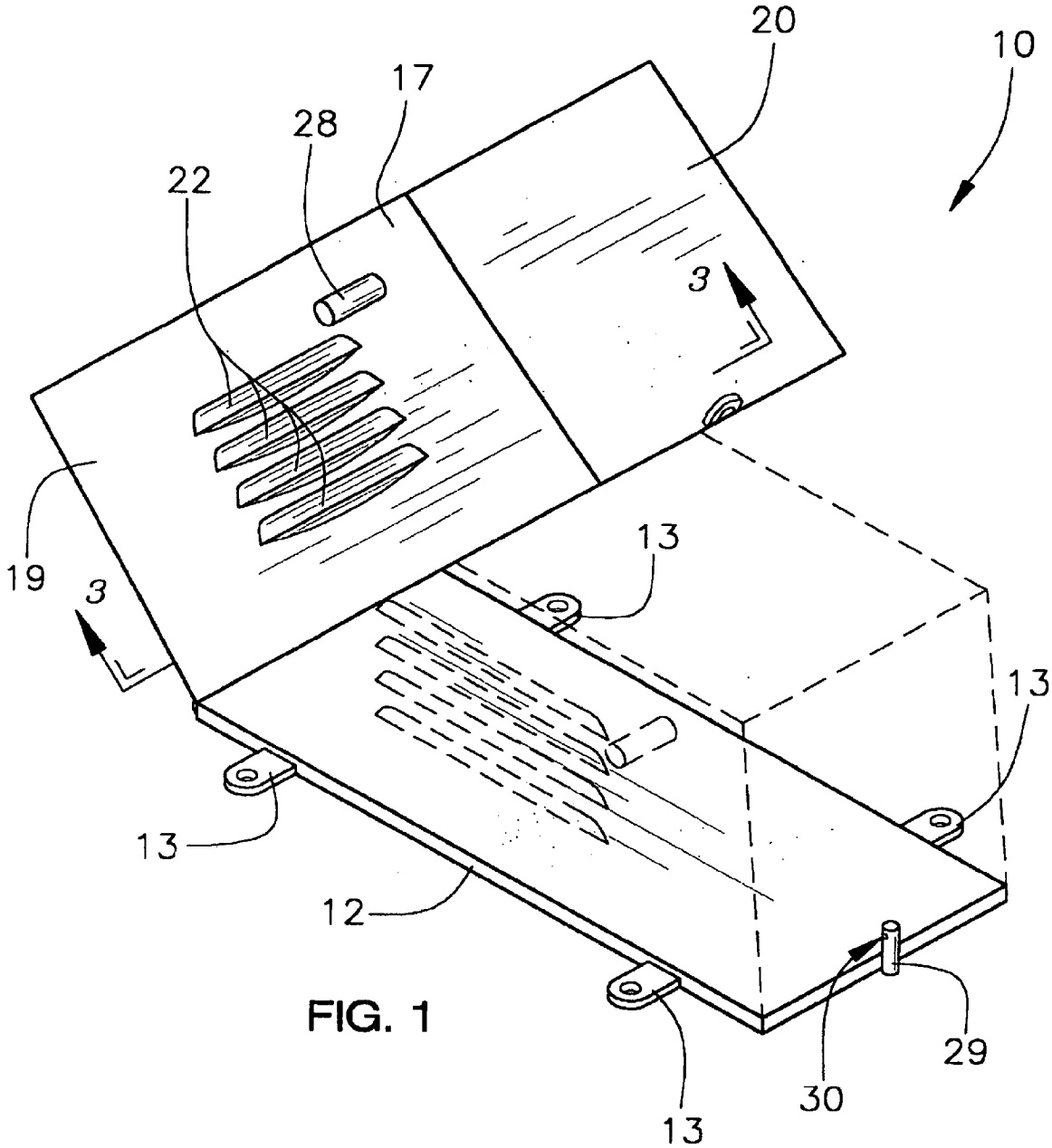
FIG. 1 is a perspective view of a new outdoor storage structure according to the present invention.
Figure 2:
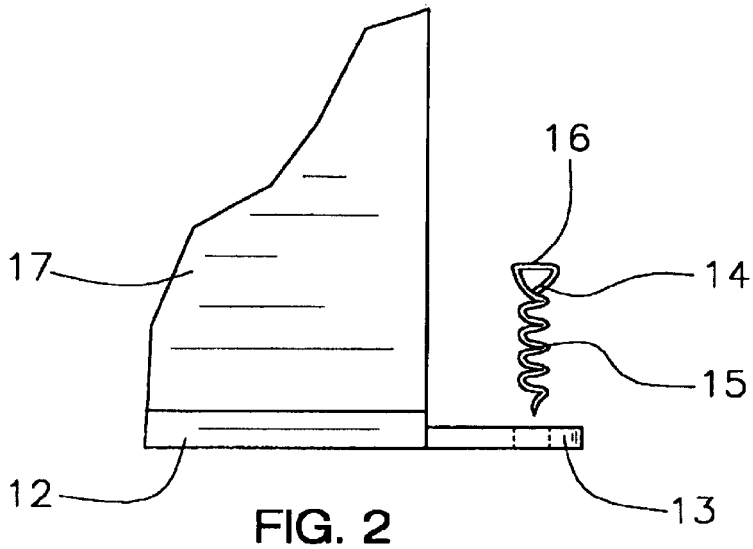
FIG. 2 is a partial side elevational view of the present invention.
Figure 3:
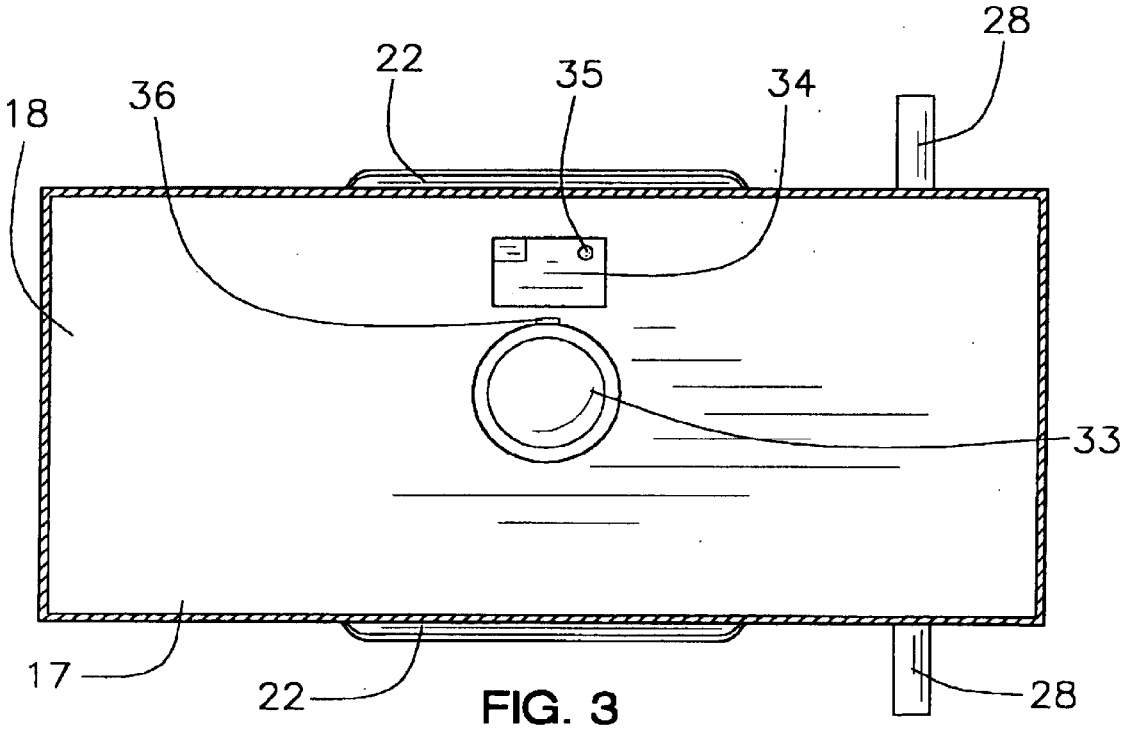
FIG. 3 is a top plan view of the present invention.
Figure 4:
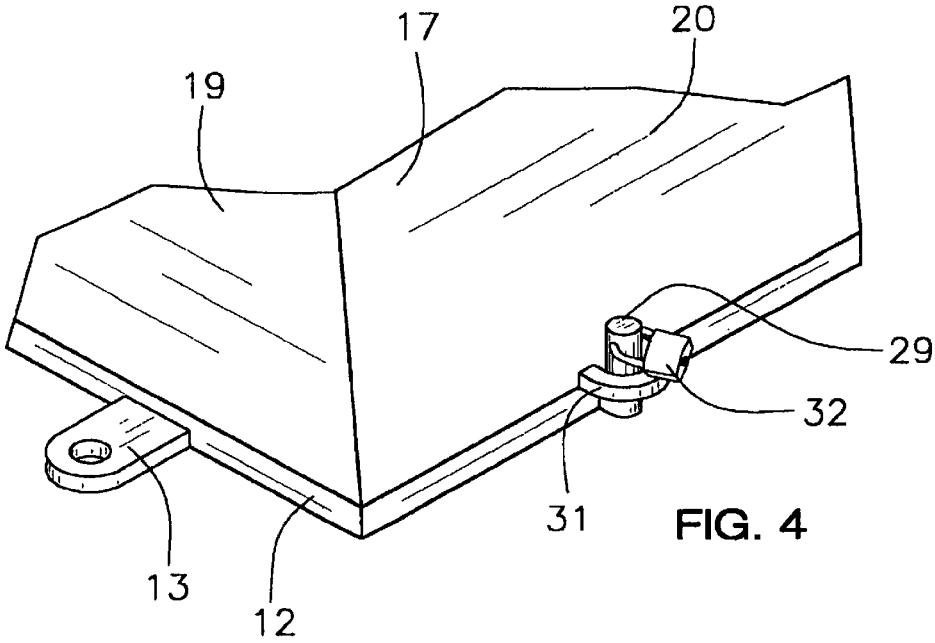
FIG. 4 is a partial front perspective view of the present invention.
Figure 5:
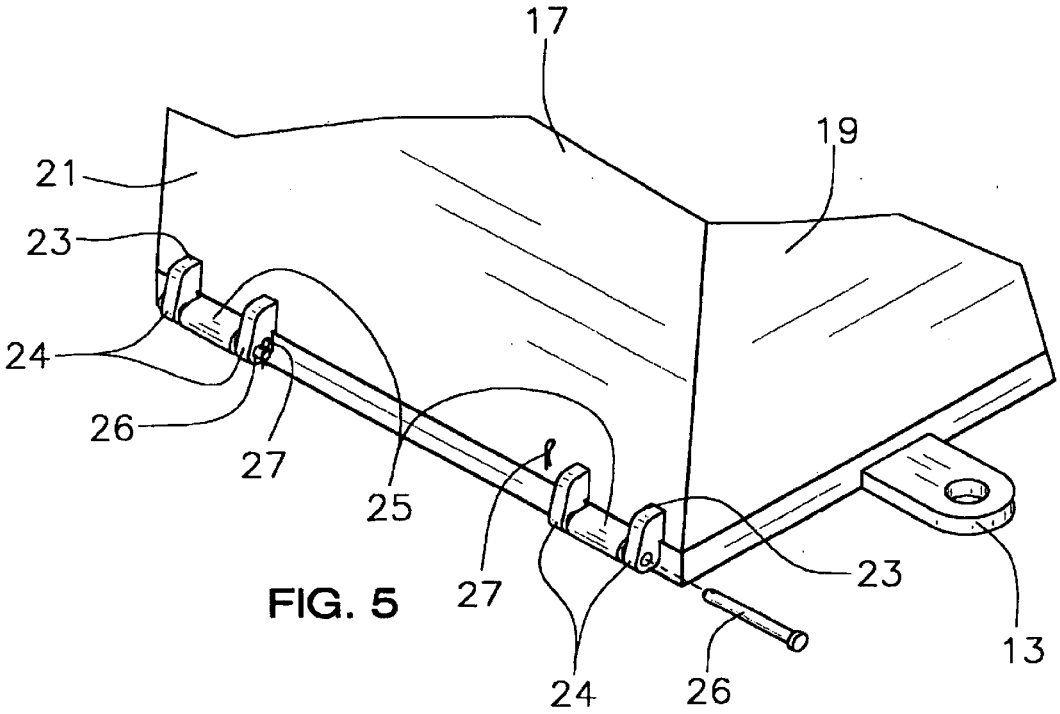
FIG. 5 is a partial rear perspective view of the present invention.

With reference now to the drawings, and in particular to FIGS. 1 through 5 thereof, a new outdoor storage structure embodying the principles and concepts of the present invention and generally designated by the reference numeral 10 will be described.

As best illustrated in FIGS. 1 through 5, the outdoor storage structure 10 generally comprises a base assembly including a base floor 12 and anchor members 13–16 being conventionally attached to sides of the base floor 12 for anchoring the base floor 12 to a ground. Each of the anchor members 13–16 includes a tongue-like eyelet 13 extending outwardly from a respective side of the base floor 12, and also includes a stake member 14 being removably disposed through the tongue-like eyelet 13 and having a helical portion 15 and a handle portion 16.

A cover member 17 is hingedly attached along a back edge of the base floor 12 and includes top, side, front, and back walls 18–21. The cover member 17 further includes a plurality of elongate vents 22 being conventionally disposed through the side walls 19 thereof. Hinge members 23 are conventionally attached to the base floor 12 and to the cover member 17. Each of the hinge members 23 include a pair of bracket members 24 being spaced apart and being securely attached along a back edge of the base floor 12, and further includes a tubular member 25 being securely attached along a bottom edge of the back wall 21 and being pivotally disposed between the pair of bracket members 24, and also includes a bolt member 26 being removably disposed through the tubular member 25 and through the bracket members 24, and further includes a securing member 27 such as a cotter pin or a padlock being removably disposed through a hole in the bolt member 26 to secure the bolt member 26 to the bracket members 24 and to the tubular member 25.

Handle members 28 are conventionally attached to the cover member 17 for the lifting thereof. The handle members 28 include dowel-like members extending outwardly from the side walls 19 of the cover member 17. A lock assembly for locking the cover member 17 to the base assembly includes a post member 29 being securely and conventionally attached at a front edge of the base floor 12 and having a bore 30 extending laterally therethrough, and also includes an eyelet member 31 being conventionally attached at a bottom edge of the front wall 20 of the cover member 17 and removably receiving the post member 29 therethrough, and further includes a lock member 32 being removably received through the bore 30 of the post member 29 for locking the cover member 17 to the base floor 112. A light-emitting member 33 having an on/off switch 36 is conventionally disposed upon an underside of the top wall 18 of the cover member 17. An alarm member 34 having a reset switch 35 is also conventionally disposed upon the underside of the top wall 18 of the cover member 17.

In use, the user sits the base floor 12 upon a suitable ground area and stakes the base floor 12 to the ground using the anchor members 13–16, and then secures the cover member 17 to the base floor 12. The user can place lawn equipment and other types of accessories upon the base floor 12 and close and secure the cover member 17 over the lawn equipment and the other types of accessories.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An outdoor storage structure comprising:

a base assembly including a base floor and anchor members being attached to sides of said base floor for anchoring said base floor to a ground;

a cover member being hingedly attached along a back edge of said base floor and including top, side, front, and back walls;

hinge members being attached to said base floor and to said cover member;

handle members being attached to said cover member for the lifting thereof;

a lock assembly for locking said cover member to said base assembly;

a light-emitting member having an on/off switch and being disposed upon an underside of said top wall of said cover member;

an alarm member having a reset switch and also being disposed upon the underside of said top wall of said cover member;

wherein said handle members include dowel-like members extending outwardly from said side walls of said cover member, each of said, handle members extending substantially orthogonally from the associated one of said side wall of said cover member such that each of said handle member is easily gripped by a user positioned in front of, beside and behind each of said handle member.

2. An outdoor storage structure as described in claim 1, wherein each of said anchor members includes a tongue-like eyelet extending outwardly from a respective side of said base floor, and also includes a stake member being removably disposed through said tongue-like eyelet and having a helical portion and a handle portion.

3. An outdoor storage structure as described in claim 1, wherein said cover member further includes a plurality of elongate vents being disposed through said side walls thereof.

4. An outdoor storage structure as described in claim 1, wherein each of said hinge members includes a pair of bracket members being spaced apart, and being securely attached along a back edge of said base floor, and further includes a tubular member being securely attached along a bottom edge of said back wall and being pivotally disposed between said pair of bracket members, and also includes a bolt member being removably disposed through said tubular member and through said bracket members, and further includes a securing member being removably disposed through said bolt member to secure said bolt member to said bracket members and to said tubular member.

5. An outdoor storage structure as described in claim 1, wherein said lock assembly includes a post member being securely attached at a front edge of said base floor and having a bore extending laterally therethrough, and also includes an eyelet member being attached at a bottom edge of said front wall of said cover member and removably receiving said post member therethrough, and further includes a lock member being removably received through said bore of said post member for locking said cover member to said base floor.

6. An outdoor storage structure comprising:

a base assembly including a base floor and anchor members being attached to sides of said base floor for anchoring said base floor to a ground, each of said anchor members including a tongue-like eyelet extending outwardly from a respective side of said base floor, and also including a stake member being removably disposed through said tongue-like eyelet and having a helical portion and a handle portion;

a cover member being hingedly attached along a back edge of said base floor and including top, side, front, and back walls, said cover member further including a plurality of elongate vents being disposed through said side walls thereof;

hinge members being attached to said base floor and to said cover member, each of said hinge members including a pair of bracket members being spaced apart and being securely attached along a back edge of said base floor, and further including a tubular member being securely attached along a bottom edge of said back wall and being pivotally disposed between said pair of bracket members, and also including a bolt member being removably disposed through said tubular member and through said bracket members, and further including a securing member being removably disposed through said bolt member to secure said bolt member to said bracket members and to said tubular member;

handle members being attached to said cover member for the lifting thereof, said handle members including dowel-like members extending outwardly from said side walls of said cover member, each of said handle members extending substantially orthogonally from the associated one of said side wall of said cover member such that each of said handle member is easily gripped by a user positioned in front of, beside and behind each of said handle member;

a lock assembly for locking said cover member to said base assembly, said lock assembly including a post member being securely attached at a front edge of said base floor and having a bore extending laterally therethrough, and also including an eyelet member being attached at a bottom edge of said front wall of said cover member and removably receiving said post member therethrough, and further including a lock member being removably received through said bore of said post member for locking said cover member to said base floor;

a light-emitting member having an on/off switch and being disposed upon an underside of said top wall of said cover member; and an alarm member having a reset switch and also being disposed upon the underside of said top wall of said cover member.

* * * * *